United States Patent [19]

Lewis

[11] 4,276,730

[45] Jul. 7, 1981

[54] BUILDING WALL CONSTRUCTION

[76] Inventor: David M. Lewis, 7 McNear Dr., San Rafael, Calif. 94901

[21] Appl. No.: 54,305

[22] Filed: Jul. 2, 1979

[51] Int. Cl.[3] ..... E04B 1/62; E04C 2/52

[52] U.S. Cl. ..... 52/221; 52/349; 52/407; 52/612; 174/48

[58] Field of Search ..... 174/48, 49; 52/220, 52/221, 241, 242, 243, 289, 612, 349, 350, 407

[56] References Cited

U.S. PATENT DOCUMENTS

| | | | |
|---|---|---|---|
| 1,406,989 | 2/1922 | Lichtenberg et al. | 52/241 |
| 1,793,188 | 2/1931 | Noerenberg | 52/289 |
| 1,985,196 | 12/1934 | Tashjian | 52/241 |
| 1,999,741 | 4/1935 | Schultz | 52/242 |
| 2,104,877 | 1/1938 | Levy | 52/300 |
| 2,107,144 | 2/1938 | Davis et al. | 52/241 |
| 2,256,394 | 9/1941 | Lamel | 52/243 |
| 3,195,698 | 7/1965 | Codrea | 52/241 |
| 3,983,670 | 10/1976 | Lightfoot | 52/241 |

FOREIGN PATENT DOCUMENTS

| | | | |
|---|---|---|---|
| 481597 | 3/1952 | Canada | 52/612 |

*Primary Examiner*—James L. Ridgill, Jr.
*Attorney, Agent, or Firm*—Melvin R. Stidham

[57] ABSTRACT

Wall structure modules comprising a plurality of narrow, substantially ceiling high panels of integral sandwich construction with a thickness of insulation molded between two thicknesses of light weight concrete. There are tongue and groove configurations along opposite sides of the panels conditioning them to be nested together. A full-height steel stud is encased in each exterior panel and has a small bracket at the top exposed for attachment of a top plate, which fits over the panels of a complete wall section to unitize it. Interior panels are similar but the steel studs are full height in every other panel only. A transverse channel extends across the bottom of each panel on the inside, the lower flange of which is secured to the sub-floor. In the assembled wall these channels are aligned to serve as a conduit for plumbing and electrical wiring.

4 Claims, 7 Drawing Figures

BUILDING WALL CONSTRUCTION

BACKGROUND OF THE INVENTION

The increasing costs of labor and material have contributed to the inflationary costs of construction. Advantages of modular building methods have long been realized, but such systems generally do not provide flexibility in design and construction. Further, attempts to provide modular units which are easily handled by a small crew and still have adequate structural strength have not been successful.

OBJECTS OF THE INVENTION

It is an object of this invention, to provide wall structure modules which are easily handled and structually sound.

It is a further object of this invention to provide wall structure modules which may be assembled in a wide variety of designs and configurations.

It is a further object of this invention to provide wall structure modules which may be assembled to form a rigid unitized building structure.

Other objects and advantages of this invention become apparent from the description to follow, particularly when read in conjunction with the accompanying drawings.

SUMMARY OF THE INVENTION

In carrying out this invention, I provide a plurality of narrow panels having interior and exterior thicknesses of concrete molded around a thickness of foam insulation. A full height, steel "C" channel stud is cast within each panel and, secured to the tops of these stud, are exposed steel attachment brackets to which a wall-unitizing steel channel cap is secured, by self-threading screws. A channel is welded to the stud of each panel to extend across the bottom of the interior side and the sides of the panels are formed in tongue and groove configuration. Hence, the panels may be nested together and the lower flange of the bottom channel is secured to the floor. When a wall is assembled, and secured by the steel channel cap, the bottom cross channels are aligned to serve as a conduit for plumbing and electrical wiring. Certain panels function as corner posts and may be of somewhat thicker construction and more heavily reenforced. Other panels omit the tongue and groove configurations on one side to function as door and window openings. Certain panels have electrical outlet boxes exposed to the interior wall and a length of pipe extends from the box to and through the upper flange of the lower transverse channel.

DESCRIPTION OF A PREFERRED EMBODIMENT

Figure 1:
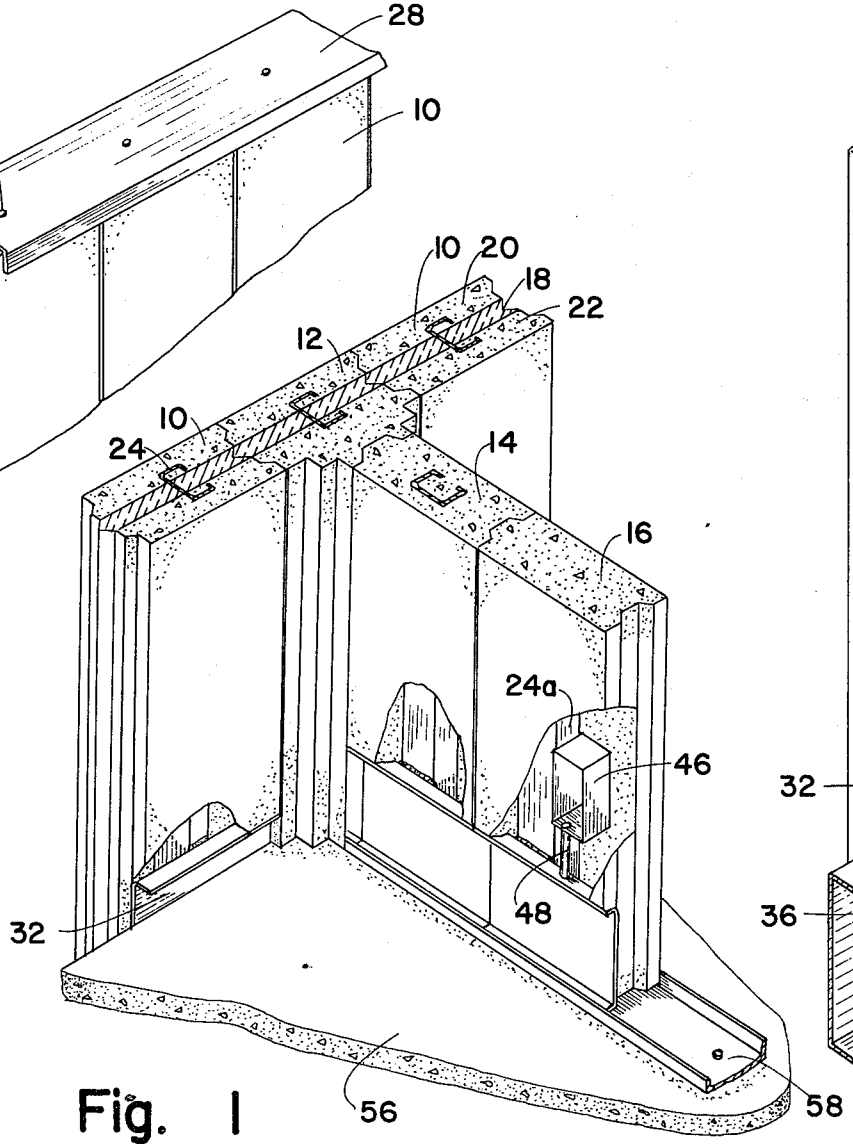
FIG. 1 is a view in perspective illustrating the assembly of portions of exterior and interior walls.

Referring now to FIG. 1 with greater particularity, there are shown assembled a series of exterior wall panels 10, an exterior to interior wall connector panel 12 and interior wall panels 14 and 16. The exterior wall panels are all of sandwich construction comprising a thickness of insulation 18, such as polystyrene between two thicknesses 20 and 22 of lightweight concrete, all molded together in integral construction.

Figure 2:
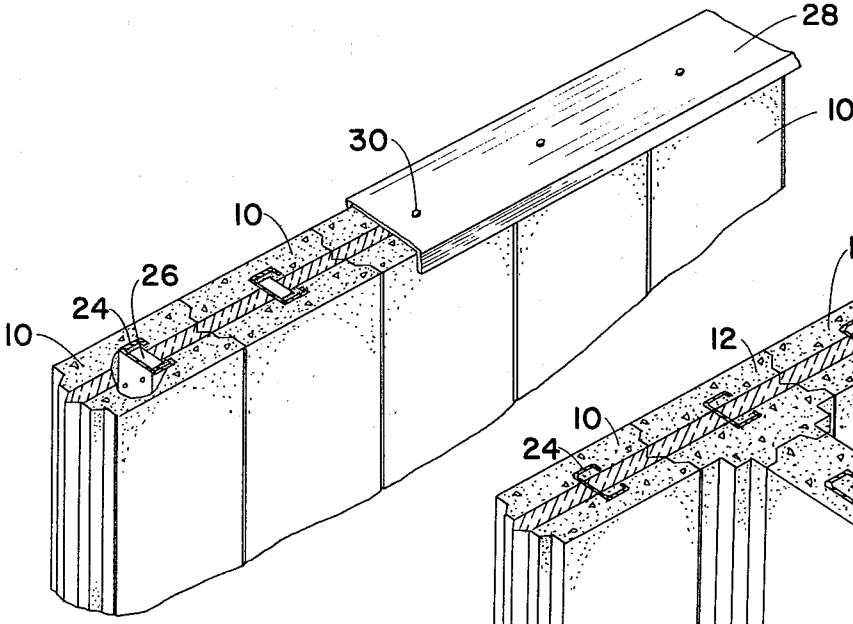
FIG. 2 is a partial view in perspective showing the upper portion of a wall with interconnecting top plate.

Cast within the panels 10, 12, 14 and 16 are steel channel studs and, as shown in FIG. 2, in exterior wall panels 10, 12, the stud extends full height to be exposed at the top. A small angle 26 is secured to the top of each stud 24 and, when a wall is completed, a channel top plate or cap 28 is placed over the panels 10 and secured to the exposed angles 26 as by means of self-threading screws 30 to tie the panels together rigidly. In alternating interior panels 14 and 16 the studs **24*a*** need not extend full height.

Figure 3:
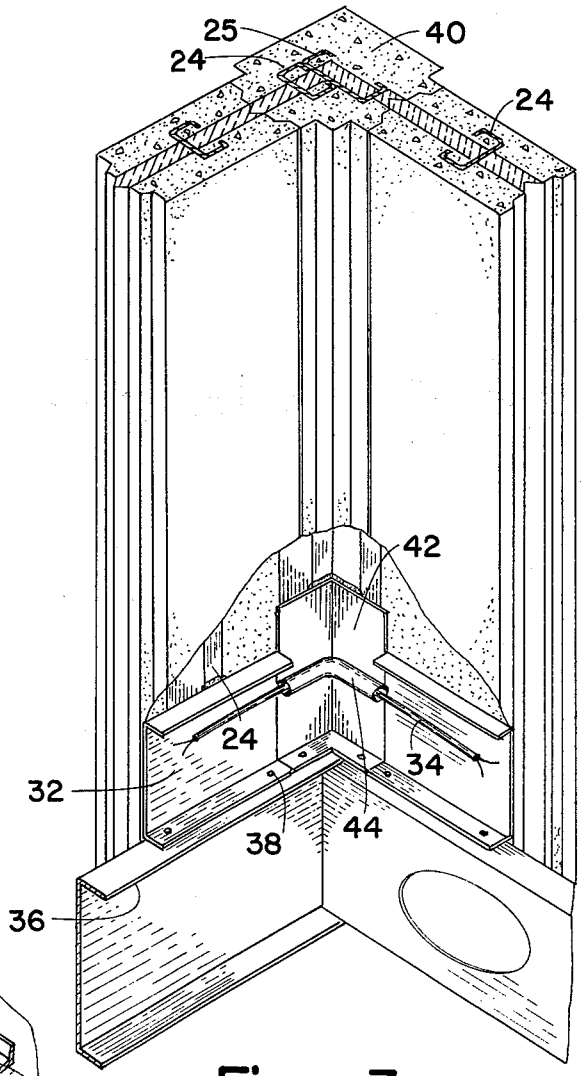
FIG. 3 is a partial view in perspective showing a building corner assembly.

The channel chase 32 is welded transversely of the lower end of the stud 24 (and to the short studs **24*a* of alternate interior panels) to extend across the bottom of the panel (FIGS. 1 & 3), and provide a conduit for piping (not shown) and wiring 34. The channels are secured to the floor, such as steel channel rim joists 36, by means of screws 38**.

The corner unit 40 is of thicker construction and includes an additional, larger steel stud 25 for additional strength. At the bottom, an angle 42 is welded to the studs 24, 25 and carries a tubular conduit 44 to facilitate carrying the wiring 34 around the corner.

Certain of the panels 16 have electrical outlet boxes 46 cast therein with tubing 48 connected between it and the channel chase 36 through the upper flange thereof to facilitate wiring.

Figure 4:
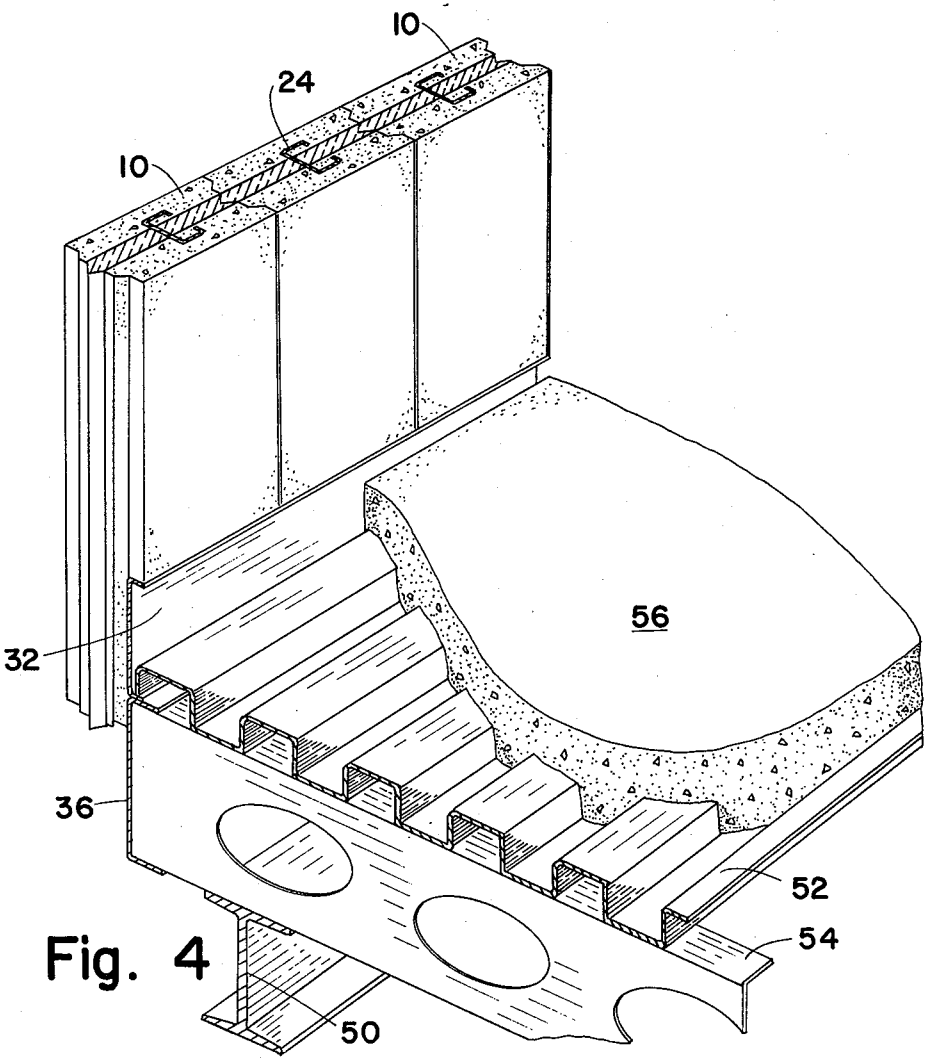
FIG. 4 is a partial view in perspective showing foundation floor and wall assembly.

Referring now to FIG. 4, when the exterior walls 10 are assembled on the rim joists 36, which in turn are supported on foundation members 50, a steel decking 52 is placed on the joist 54 and a floor of concrete 56 is poured. Then, the interior walls 14, 16 (FIG. 1) are assembled along tracks 58 secured on the sub floor 56. In the alternative, the track 58 may be secured to the decking 52 and the interior walls erected before the concrete sub floor 56 is poured.

Figure 5:
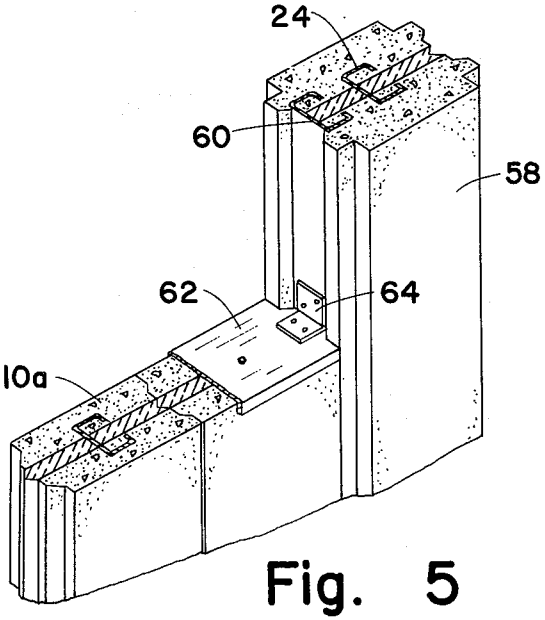
FIG. 5 is a partial view in perspective showing a window sill.

Referring now to FIG. 5, certain of the panels omit the tongue and groove configuration from at least one side over at least a portion of their height to form window or door openings. In the case of panel 58, the tongue on the left side is replaced by a stud 60 with web exposed to which a window frame (not shown) may be secured. On the opposite side of the window a similar channel will replace the groove configuration over the height of the window opening. A sill plate 62 is secured across the top of short panels **10*a* by means of angles 64 secured to the stud 60**.

Figure 6:
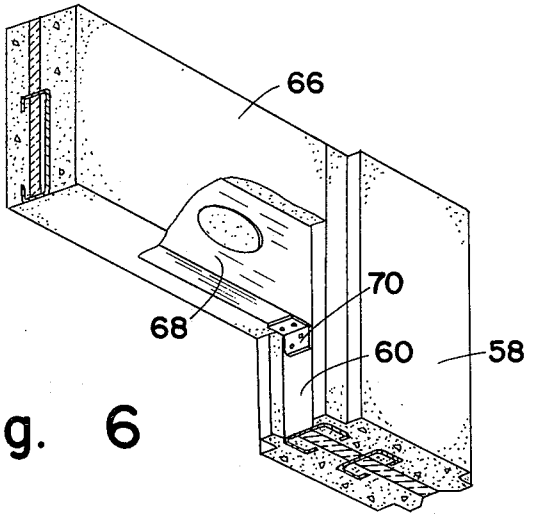
FIG. 6 is a partial view in perspective showing a window header.

Referring now to FIG. 6 a window or door header 66 has a steel joist 68 cast therein for securing the header 66 to the stud 60 by means of angle 70.

Figure 7:
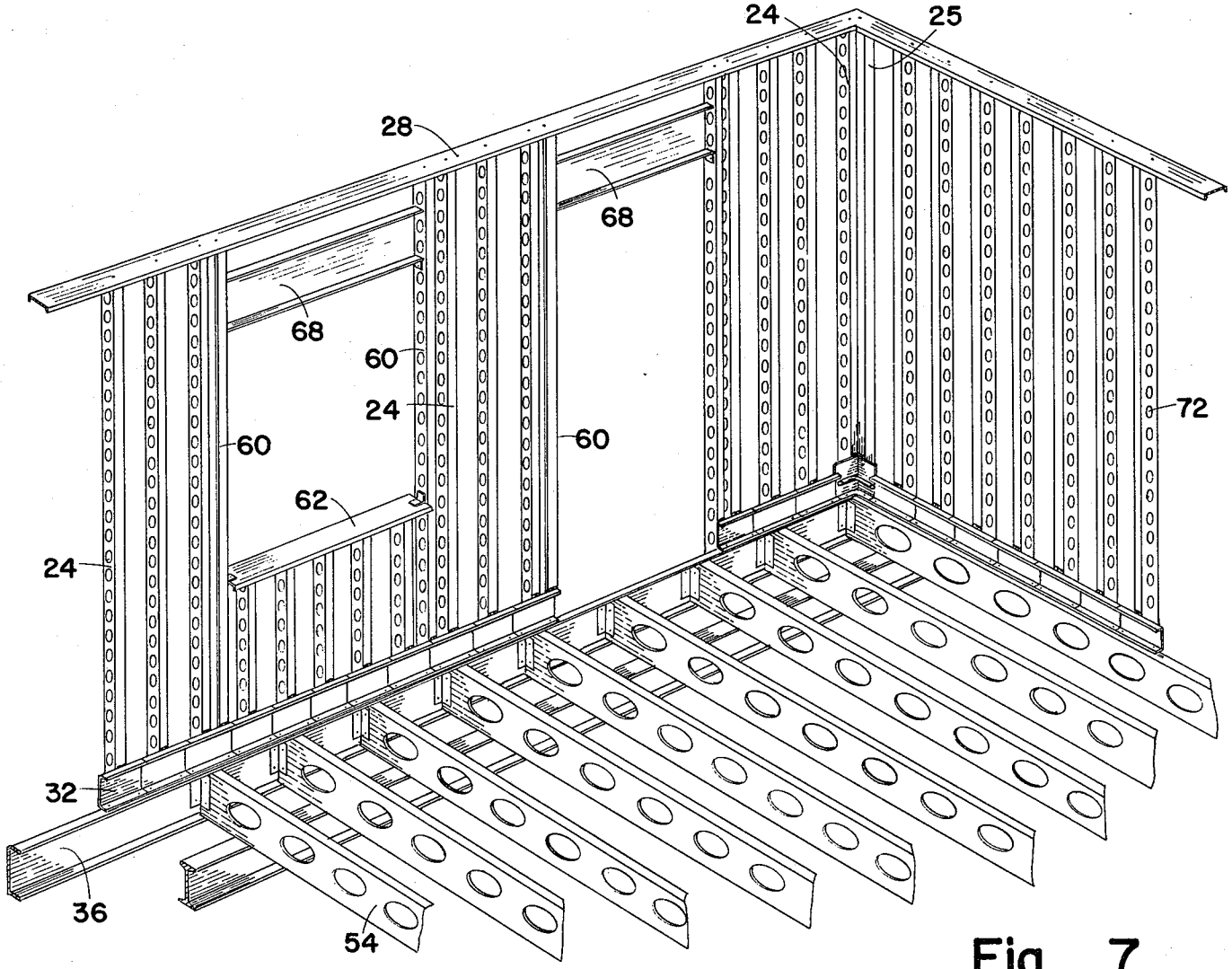
FIG. 7 is a view in perspective showing a skeltonized structure illustrating how the steel components of the panels are tied together.

Referring now to FIG. 7 there is illustrated the manner in which the steel reinforcing structures of the panels are tied together to form a unitized structure. As shown, the bottom cross channels 32 which are welded to the studs 24 and **24*a* are secured to the rim joists 36** and, after a wall section is assembled, the panels are united by means of the top plate 28. Similarly, studs 60 across the window opening are tied together by header 68 and sill plate 62 and across the door way the studs 60 are united by header 68. As shown, some or all of the studs may be provided with openings 72 along their length to minimize weight and to increase the bond with the lightweight concrete.

While this invention has been described in conjunction with a preferred embodiment thereof, it is obvious that modifications and changes therein may be made by those skilled in the art without departing from the spirit and scope of this invention, as defined by claims appended hereto.

What is claimed as invention is:

1. Wall structure modules comprising:

a plurality of narrow, substantially ceiling high panels of lightweight concrete;

tongue and groove configurations along opposite sides of said panels conditioning them to be nested together in juxtaposition;

a full height load bearing steel "c" stud embedded in certain of said panels;

a cap channel adapted to fit over and along the tops of a plurality of nested panels;

means for securing said cap members to the load bearing studs in said nested panels;

means forming a horizontal raceway for piping and electrical conduits across the lower ends of said panels;

an electric outlet box in at least one of said panels opening to the interior surface thereof; and a duct depending from said outlet box and opening into said raceway.

2. The wall structure modules defined by claim 1 including:

small angles secured to the tops of said steel studs presenting horizontal portions for attachment of said steel channel.

3. The wall structure defined by claim 1 wherein;

said raceway is formed by aligned horizontal channels welded to said across the lower end thereof; and including:

joists to be secured across opposing surrounding rim joists; and means for securing the lower flange of said channel raceways to said rim joists.

4. The wall structure defined by claim 1 wherein said panels comprise:

a thickness of a foam type insulation material interposed between inner and outer thicknesses of lightweight concrete.

* * * * *